US007228994B2

(12) United States Patent
Noyes et al.

(10) Patent No.: US 7,228,994 B2
(45) Date of Patent: Jun. 12, 2007

(54) DELAYED FLOW WATER RESERVOIR FOR A CLOTHES DRYING CABINET AND METHOD OF USE

(75) Inventors: Bethany C. Noyes, Dubuque, IA (US); Dennis S. Prows, Cincinnati, OH (US); Don J. Rydberg, Ankeny, IA (US)

(73) Assignee: Maytag Corporation, Newton, IA (US)

( * ) Notice: Subject to any disclaimer, the term of this patent is extended or adjusted under 35 U.S.C. 154(b) by 199 days.

(21) Appl. No.: 10/642,842

(22) Filed: Aug. 18, 2003

(65) Prior Publication Data

US 2005/0040184 A1 Feb. 24, 2005

(51) Int. Cl.

| | |
|---|---|
| ***B67D 1/008*** | (2006.01) |
| ***B67D 3/00*** | (2006.01) |
| ***A65D 47/00*** | (2006.01) |
| ***D03D 39/10*** | (2006.01) |

(52) U.S. Cl. ..... 222/477; 222/188; 222/479; 139/44; 8/158

(58) Field of Classification Search ..... 222/424.5, 222/457, 185.1, 427, 21, 482, 487, 181.1–181.3, 222/188, 454, 456, 477, 479; 8/158; 239/44; 139/44

See application file for complete search history.

(56) References Cited

U.S. PATENT DOCUMENTS

| | | | | |
|---|---|---|---|---|
| 2,022,271 | A * | 11/1935 | Bibb | 222/207 |
| 2,333,310 | A * | 11/1943 | Greening | 222/481 |
| 2,714,977 | A | 8/1955 | Davis | |
| 3,193,160 | A * | 7/1965 | Veit et al. | 222/440 |
| 3,651,995 | A * | 3/1972 | Chaney | 222/211 |
| 4,881,667 | A * | 11/1989 | Perakis | 222/437 |
| 5,048,723 | A | 9/1991 | Seymour | |
| 5,305,484 | A | 4/1994 | Fitzpatrick | |
| 5,427,279 | A * | 6/1995 | Kaufman | 222/207 |
| 5,542,605 | A * | 8/1996 | Campau | 239/44 |
| 5,547,615 | A * | 8/1996 | Jan e et al. | 261/24 |
| 5,561,880 | A | 10/1996 | Allen | |
| 5,815,961 | A | 10/1998 | Estes | |
| 5,819,994 | A | 10/1998 | Leipold | |
| 6,142,750 | A * | 11/2000 | Benecke | 417/411 |
| 6,427,365 | B2 | 8/2002 | MacGregor | |
| 2003/0126691 | A1 * | 7/2003 | Gerlach et al. | 8/158 |

* cited by examiner

*Primary Examiner*—Frederick C. Nicolas
*Assistant Examiner*—Melvin A. Cartagena
(74) *Attorney, Agent, or Firm*—McKee, Voorhees & Sease, P.L.C.

(57) ABSTRACT

A delay flow water reservoir for a clothes dryer cabinet and method of use is provided. The delay flow reservoir has a container having an opening and a cap engaging the opening. The cap has a delay chamber with a drain opening, a seal covering the opening with first and second seal holes, and the delayed flow reservoir. The delay chamber fills with water from the container before draining into the clothes drying cabinets. The method of using the delay flow water reservoir permits the user to fill a container while in an upright position and then moving the delay flow water reservoir to an overturned dispense position. The method permits water to drain into the delay reservoir rather than out the drain opening while the user moves the reservoir into operational communication in the clothes drying cabinet.

12 Claims, 3 Drawing Sheets

DELAYED FLOW WATER RESERVOIR FOR A CLOTHES DRYING CABINET AND METHOD OF USE

BACKGROUND OF THE INVENTION

Clothes drying cabinets, which are more common in Japan than in the United States, are used for drying clothes without the conventional tumbling action. As opposed to a conventional tumbler dryer, a drying cabinet provides heated air for drying clothes hanging in the cabinet. Drying cabinets can also be used for de-wrinkling clothes. The de-wrinkling process includes the introduction of steam into the cabinet, which facilitates the removal of wrinkles from the clothes.

Conventional drying cabinets typically create steam by providing water from a water reservoir to a heater/steamer. Typically, conventional drying cabinets do not have an easily removable and fillable water reservoir. As seen in U.S. Pat. No. 5,815,961 issued to Estes, conventional drying cabinets may have a removable water reservoir; however, the reservoir is located in an inconvenient location which may be awkward to remove and difficult to monitor. In addition, Estes uses a valve underneath the water reservoir which may be difficult to position and uses moving parts which may fail or leak.

Accordingly, a primary feature of the present invention is the provision of an improved water reservoir for a clothes drying cabinet.

Another feature of the present invention is the provision of an improved clothes drying cabinet having a water reservoir which is conveniently located, easily removed, and easy to monitor.

A further feature of the present invention is the provision of an improved water reservoir for a clothes drying cabinet that does not use moving parts.

These and other features of the present invention will be apparent from the following description.

SUMMARY OF THE INVENTION

The foregoing features may be achieved by a delayed flow reservoir that has a container with an opening, a seal covering the opening with first and second seal holes, and a cap threaded on the container and having a delay chamber and a water drain tower. The delay chamber of the cap communicates with the first and second seal holes of the container. The drain tower of the cap has a passageway which communicates with the delay chamber. The foregoing features may also be achieved by a method of using the delayed flow reservoir in a clothes dryer cabinet that includes filling the container in an upright fill position, attaching the delay flow reservoir cap, and then turning the container over. The method also has the step of positioning the delay flow water reservoir into the clothes drying cabinet in the overturned position while water flows into the delay chamber but not yet out of the drain tower.

DETAILED DESCRIPTION OF THE INVENTION

Figure 1:
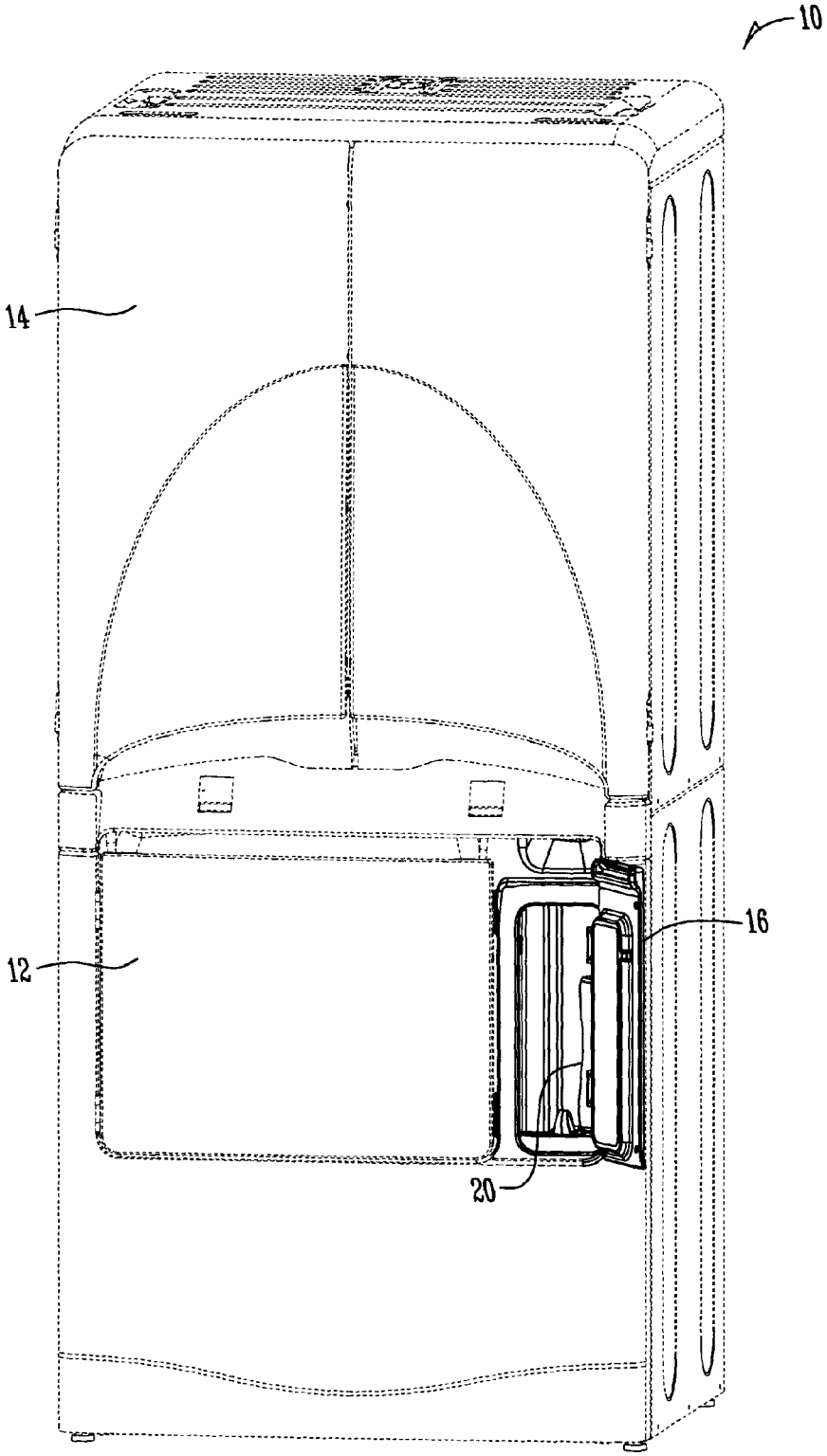
FIG. 1 is a perspective view of a combination tumble dryer and drying cabinet with the water reservoir access door open exposing the delayed flow water reservoir.

FIG. 1 shows a combination clothes drying machine 10 having a tumble dryer 12 and a drying cabinet 14. The drying cabinet 14 is shown to be mounted on top of the tumble dryer 12, though it is understood that other configurations can be provided. The clothes drying machine 10 includes a water reservoir access door 16 to provide access to a delayed flow water reservoir 20.

Figure 2:
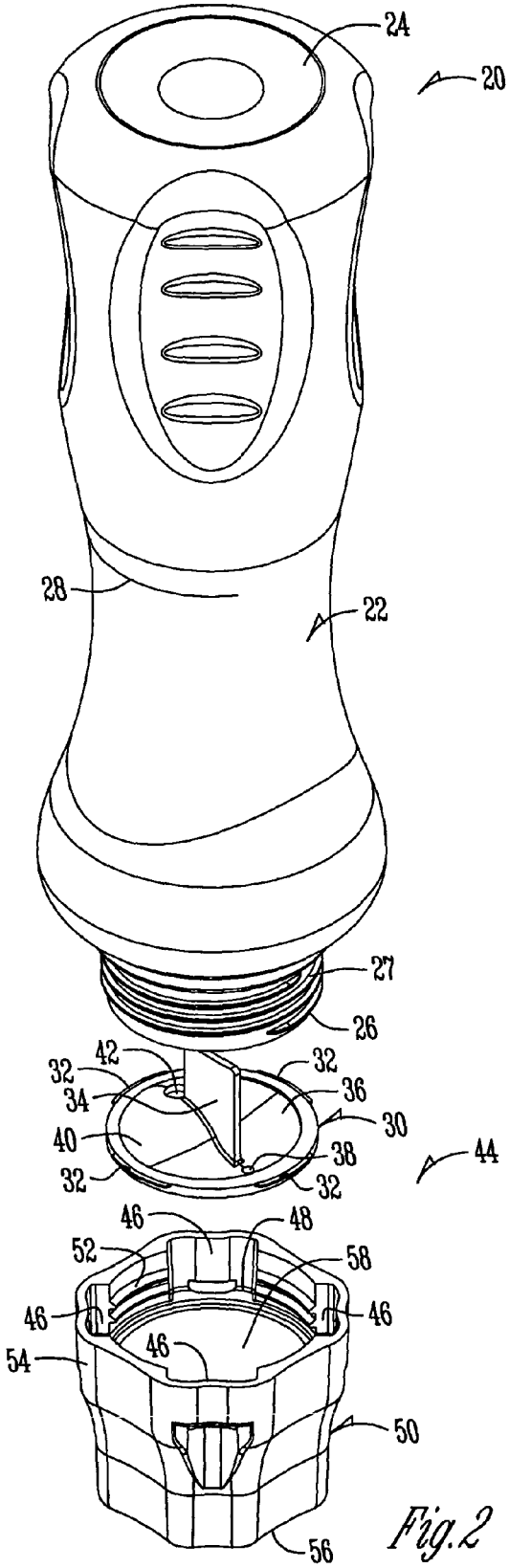
FIG. 2 is an exploded view of the delayed flow water reservoir.

As seen in FIG. 2, the water reservoir 20 has a water bottle or container 22 with a closed end 24 and an open end 26. The open end 26 has a threaded neck 27. The water bottle 22 is made of a clear plastic such that the volume of remaining contents in the bottle 22 may be determined. Alternatively, the water bottle may be translucent. A minimum fill line 28 is provided to indicate to a user that an appropriate amount of water has been added to the water bottle 22. The bottle 22 is sized to be hand-held.

The water reservoir 20 also has a seal 30. This seal 30 is sized to cover the open end 26 of the water bottle 22. This seal 30 has a circumferential tabs 32 which are provided to secure the seal to a cap 50. A handle 34 is attached to the seal 30 and provided to turn the seal 30 at approximately 45° when inside the cap 50. The seal 30 has a downward curved portion or dome 36 and a water hole 38 at a central bottom position of the downward curved portion 36. The seal also has an upward curved portion or dome 40 having an air hole 42 in a central upper position of the upward curved portion 40. The hole 38 and the hole 42 are on opposite sides of the seal 30 and vertically offset so that water will drip out of the lower hole 38 and air will enter into the upper hole 42. Water flows downwardly through the hole 38 while air flows upwardly through the hole 42 due to the pressure differential created by the height difference between the hole 38 and hole 42. The flow rate of the water leaving the hole 38 is controlled by varying the area of hole 38.

A delayed flow cap assembly 44 is made up of the combination of the seal 30 and the cap 50. The cap 50 has an open end 52, and a body defined by a side wall 54, and a closed end 56. The side wall 54 has internal threads which mate with the threaded neck 27 of the bottle 22. Inside the cap 50 is a delay tank or delay chamber 58.

As further seen in FIG. 2, the cap 50 includes cutouts or passageways 46 and an annular groove 48. In assembly, the seal 30 is oriented so that the tabs 32 align with the cutouts 46 of the cap 50. The seal 30 is pushed into the cap 50 until it is seated in the groove 48 and is then turned approximately 45° to lock the circumferential tabs 32 within the groove 48.

Figure 3:
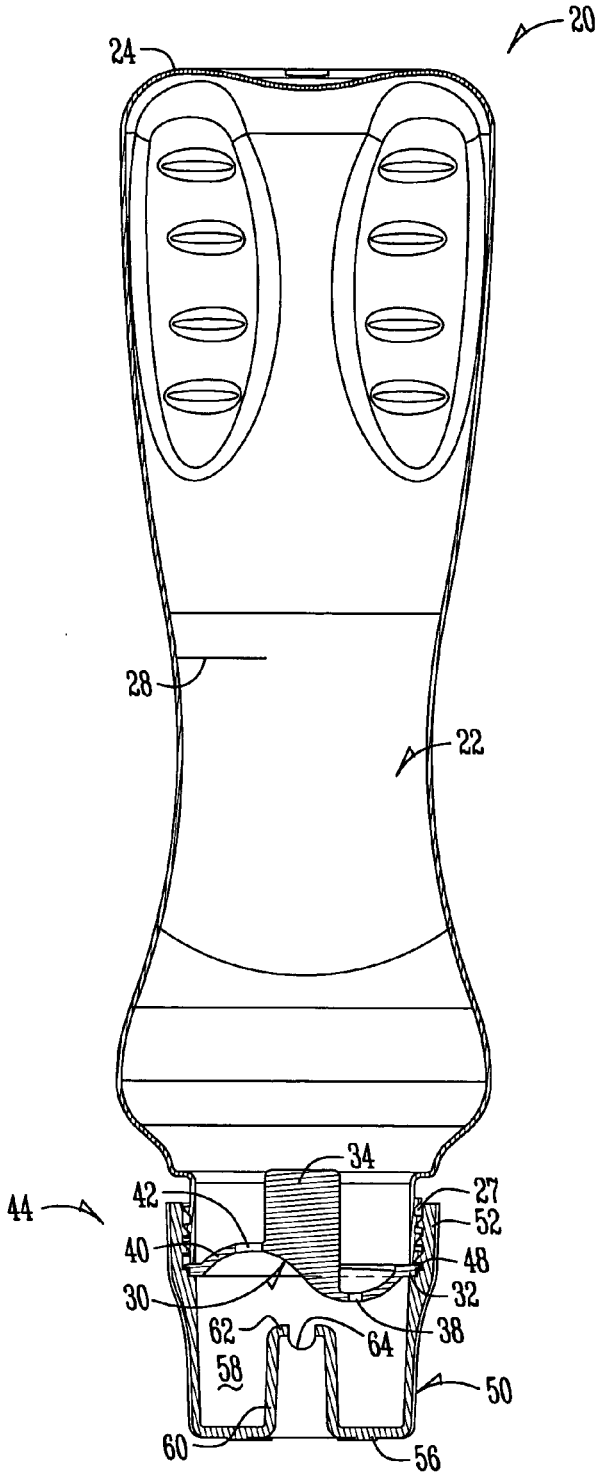
FIG. 3 is a sectional view of the delayed flow water reservoir taken along a center line.

As further seen in FIG. 3, the delayed flow water reservoir 20 has a drain tower 60 extending upwardly from the closed end 56 of the cap 50. The tower 60 has a partial cover 62 defining a passageway or drain opening 64.

In use, the delayed flow water reservoir 20 begins as separate components of water bottle 22, seal 30, and cap 50. In the unassembled form the individual components may be easily cleaned. The delayed flow cap assembly 44 is then assembled by placing the seal 30 inside the cap 50. The seal 30 is positioned such that the tabs 32 are in alignment with projection passageway 46. Once in alignment, the seal is lowered down inside the cap 50 until it reaches the groove 48. In this position, the user then rotates the seal 30 by gripping the handle 34 and rotating approximately 45° to lock the seal 30 in the cap 50.

The user then holds upright the water bottle 22 such that it may be filled from a water faucet or other water receptacle. The delayed flow water reservoir cap assembly 44 is then screwed onto the neck 27 of the container 22. It is to be understood that alternate ways of attaching the cap 50 to the bottle 22 can be provided.

The user then turns the bottle 22 over to a water dispense position as shown in FIG. 3. Once the water reservoir 20 is moved into the dispense position, water begins flowing from the container 22 through the hole 38 and the container 22 begins accepting air from the hole 42 into the container 22. The air flow prevents a vacuum from being formed within the container 22 and permits water to flow out of the hole 38.

Water flowing out of hole 38 begins filling the delay chamber 58. During this period of water moving into the delay chamber 58, the user places the delayed flow water reservoir 20 into operational communication within the clothes drying cabinet 10. The delay chamber 58 functions to delay the water flow out of the reservoir 20 for a short amount of time, but eventually the water fills the delay chamber 58 and flows out the drain opening 64 in the tower 60. As water continues to flow out the hole 64 in the tower 60, air flows upwardly through the hole 64 into the delay chamber 58. The air from the delay chamber 58 then continues through the air hole 42 into the water bottle 22. The air is permitted to enter through the exit chamber hole 64 and into the water bottle 22 because the water flow rate through the hole 38 is metered at a rate less than the flow rate out of the hole 64 of the delay chamber 58. Therefore, there is no further build up of water within the delay tank 58 once the water level reaches the drain opening 64.

Once in operational communication with the clothes dryer 10, water will continue to flow from drain opening 64 until the water level outside the water reservoir 20 reaches the closed end 56 of cap 50. At this point, air flow can no longer enter the drain opening 64 and the reservoir is said to be in a vapor-locked condition. No more water will flow from water hole 38 until the dryer 10 utilizes enough water to drop the water level outside the reservoir 20 below closed end 56 of cap 50.

Once the water reservoir 20 is empty of water the user may then remove the reservoir 20 from operational communication with the clothes drying cabinet 10 and overturn to a fill position. The partial cover 62 on the tower 60 prevents accidental spilling of any water remaining in the delay chamber 58.

The preferred embodiment of the present invention has been set forth in the drawings, specification, and although specific terms are employed, these are used in a generic or descriptive sense only and are not used for purposes of limitation. Changes in the form and proportion of parts as well as in the substitution of equivalents are contemplated as circumstances may suggest or render expedient without departing from the spirit and scope of the invention as further defined in the following claims.

What is claimed is:

1. A delayed flow reservoir, comprising:

a container having an opening;

a seal covering the opening and having first and second seal holes;

a cap engaging the opening and having a delay chamber with a floor and a drain outlet raised above the floor;

wherein water flows from the container through one of the seal holes to fill the delay chamber before flowing out the drain outlet;

wherein the outlet allows air to flow into the delay chamber while water fills the chamber and allows water to flow out of the delay chamber when the level of water in the delay chamber reaches the level of the drain outlet; and the first seal hole being below the second seal hole when the reservoir is in a dispense position.

2. The delayed flow reservoir of claim 1 wherein the container is a hand-held water bottle.

3. The delayed flow reservoir of claim 1 wherein the first seal hole is offset in a vertical direction from the second seal hole.

4. The delayed flow reservoir of claim 1 wherein the cap includes a tower extending upwardly in the delay chamber, with the drain outlet being in the tower.

5. The delayed flow reservoir of claim 1 wherein the drain outlet is below the first seal hole when the reservoir is in a dispense position.

6. The delayed flow reservoir of claim 1 wherein the drain outlet is partially covered.

7. The delayed flow reservoir of claim 1 wherein the drain outlet is larger than the first seal hole.

8. A delayed flow reservoir, comprising:

a container having an opening;

a seal covering the opening and having first and second seal holes;

a cap engaging the opening and having a delay chamber with a floor and a drain outlet raised above the floor, wherein water flows from the container through one of the seal holes to fill the delay chamber before flowing out the drain outlet;

wherein the outlet allows air to flow into the delay chamber while water fills the chamber and allows water to flow out of the delay chamber when the level of water in the delay chamber reaches the level of the drain outlet; and the seal has a downward curved portion relative to the first hole.

9. A delayed flow reservoir, comprising:

a container having an opening;

a seal covering the opening and having first and second seal holes;

a cap engaging the opening and having a delay chamber with a floor and a drain outlet raised above the floor;

wherein water flows from the container through one of the seal holes to fill the delay chamber before flowing out the drain outlet;

wherein the outlet allows air to flow into the delay chamber while water fills the chamber and allows water to flow out of the delay chamber when the level of water in the delay chamber reaches the level of the drain outlet; and the seal has an upwardly curved portion relative to the second hole.

10. A delayed flow reservoir, comprising:

a container having an opening;

a seal covering the opening and having first and second seal holes;

a cap engaging the opening and having a delay chamber with a floor and a drain outlet raised above the floor;

wherein water flows from the container through one of the seal holes to fill the delay chamber before flowing out the drain outlet;

wherein the outlet allows air to flow into the delay chamber while water fills the chamber and allows water to flow out of the delay chamber when the level of water in the delay chamber reaches the level of the drain outlet; and the first seal hole having a smaller diameter than the second seal hole.

11. A delayed flow reservoir cap, comprising:

a body adapted to engage a container having an opening;

a seal in the body with first and second seal holes for the passage of water and air, respectively;

a delay chamber in the body;

a drain outlet elevated in the delay chamber for the inlet of air as the chamber fills with water and the outlet of water upon rising to the level of the drain outlet; and the seal having a downward curved portion relative to the first hole.

12. A delayed flow reservoir cap, comprising:

a body adapted to engage a container having an opening;

a seal in the body with first and second seal holes for the passage of water and air, respectively;

a delay chamber in the body;

a drain outlet elevated in the delay chamber for the inlet of air as the chamber fills with water and the outlet of water upon rising to the level of the drain outlet; and the seal having an upwardly curved portion relative to the second hole.

* * * * *